US007623803B2

(12) United States Patent
Carolan et al.

(10) Patent No.: US 7,623,803 B2
(45) Date of Patent: Nov. 24, 2009

(54) FUSER SYSTEM OF A XEROGRAPHIC DEVICE AND A METHOD OF FUSING AN IMAGE IN A XEROGRAPHIC DEVICE INCLUDING A CLOSED LOOP CONTROL BASED ON THE TORQUE OF A DRIVE SYSTEM

(75) Inventors: Kevin M. Carolan, Webster, NY (US); David S. Derleth, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 347 days.

(21) Appl. No.: 11/737,540

(22) Filed: Apr. 19, 2007

(65) Prior Publication Data

US 2008/0260405 A1 Oct. 23, 2008

(51) Int. Cl.
*G03G 15/20* (2006.01)

(52) U.S. Cl. ..... 399/67; 399/36

(58) Field of Classification Search ..... 399/36, 399/67, 68, 122, 167, 320, 328
See application file for complete search history.

(56) References Cited

U.S. PATENT DOCUMENTS

2005/0220473 A1 * 10/2005 Bott et al. ..... 399/67

* cited by examiner

*Primary Examiner*—Hoang Ngo
(74) *Attorney, Agent, or Firm*—Oliff & Berridge PLC

(57) ABSTRACT

A fuser system of a xerographic device has a fuser member and a pressure member in which the pressure member is made to exert pressure upon the fuser member so as to form a nip. A drive system drives the fusing member and/or pressure member. A sensor monitors torque of the drive system, and a processor in communication with the sensor receives torque data from the sensor. The processor determines if the torque exceeds a predetermined value, wherein the drive system holds the fuser member and the pressure member in a partially loaded state when the torque exceeds the predetermined value.

20 Claims, 2 Drawing Sheets

FUSER SYSTEM OF A XEROGRAPHIC DEVICE AND A METHOD OF FUSING AN IMAGE IN A XEROGRAPHIC DEVICE INCLUDING A CLOSED LOOP CONTROL BASED ON THE TORQUE OF A DRIVE SYSTEM

BACKGROUND

The exemplary embodiments relate generally to a fuser system of a xerographic device and a method of fusing an image in a xerographic device, which includes a closed loop control of the user system based on the torque applied thereto.

In the process of xerography, a light image of an original to be copied is typically recorded in the form of a latent electrostatic image upon a photosensitive member with subsequent rendering of the latent image visible by the application of particulate thermoplastic material, commonly referred to as toner. The visual toner image can be either fixed directly upon the photosensitive member or transferred from the member to another support, such as a sheet of plain paper, with subsequent affixing of the image thereto, one method of affixing including the application of heat and pressure.

In order to affix or fuse toner material onto a support member by heat and pressure, it is necessary to elevate the temperature of the toner and simultaneously apply pressure sufficient to cause the constituents of the toner to become tacky and coalesce. In both the xerographic as well as the electrographic recording arts, the use of thermal energy for fixing toner images onto a support member is known.

One approach to heat and pressure fusing of toner images onto a support has been to pass the support with the toner images thereon between a pair of pressure engaged roller members, at least one of which is internally heated. For example, the support may pass between a fuser roller and a pressure roller. During operation of a fusing system of this type, the support member to which the toner images are electrostatically adhered is moved through the nip formed between the rolls with the toner image contacting the fuser roll thereby to effect heating of the toner images within the nip.

However, when the pair of pressure engaged roller members, at least one of which is internally heated, are not at an adequate temperature, such as, for example, when the xerographic device has not yet warned up, the torque reflected to the motor may be too high. That is, the torque required to rotate the loaded roll pair decreases as the temperature of roller members increases. The motor power may not be sufficient to drive the pair of rollers when the rollers are "cold." However, the load motor will continue to drive the roller members until the appropriate engaged position is achieved. This may lead to a motor stall, or other inefficiencies.

SUMMARY

More specifically, to heat and pressure fix a particulate thermoplastic material arranged in image configuration by direct contact with a heated fusing member in a xerographic imaging apparatus, a closed loop control is used. More specifically, the exemplar embodiments relate to the automatic positioning of a pressure roll relative to a fuser roll based on various parameters.

In an exemplary embodiment, as discussed in more detail below, to avoid drive motor stall and/or other malfunctions in a xerographic device, the torque of the drive motor is monitored while the role pair is engaging until the drive motor reaches a predetermined value which is lower than the maximum torque the drive motor is capable of supplying. This allows the unheated roll to warm up since it has contact with the heated roll. When more desirable factors are obtained, the roll pair can make full contact for fusing. More specifically, the exemplary embodiments provide a closed loop control of the relative position of a fuser member and a pressure member of the fuser system, based on the torque seen by the drive system. As described in more detail below, the positioning of a pair of rolls in a fuser system is controlled such that the torque used to drive the rolls to engage each other may be controlled, as needed, to avoid motor stall or other inefficiencies. After the rollers achieve a desired temperature, or other parameters are met, the torque required to drive the rolls at the required nip will be lower than when the rolls are cold.

In an exemplary embodiment, the positioning of the rolls, in a fuser system, with respect to each other is dependent on a number of different factors. For example, as discussed above, the pressure roll and fuser roll may form a nip. The nip may be formed by virtue of the fuser roll deforming the pressure roll, which is referred to as a nip forming pressure roll system. However, a nip forming fuser roll may also be utilized. In order to effect engagement of the roll members, a cam member for the pressure roll may be actuated through rotation of a shaft, which causes downward travel of the pressure roll so that it contacts the fuser roll member.

In an exemplary embodiment, the pressure roll is mounted on a cam and moves into the stationary fuser roll. The rolls may be separated, for example, to clear a paper jam, and then re-positioned. The current system uses a flag and an optical sensor to determine if the pressure roll is fully engaged or fully disengaged. The invention allows the system to determine the applied pressure by extrapolating the amount of power (monitoring drive motor voltage) required to drive the fuser/pressure roll pair.

The degree of contact, that is how far the pressure roll is pressed into the fuser roll (or the width of the nip) may depend on a number of factors including, for example, the type of support member to which the toner images are electrostatically adhered to, the type of toner used, the temperature of the rolls, etc.

For example, in the xerographic imaging apparatus, the fuser assembly including the fuser roll and pressure roll, when not recently in use, may be cold. That is, the fuser roll and the pressure roll may be cold and thus relatively hard. Accordingly, the power needed to effectuate the appropriate degree of contact between the rolls must be greater to compensate for the colder rolls. For example, when the rolls are relatively warmer, they are more pliable and less pressure is needed to achieve a specific degree of contact (or width of the nip). Accordingly, when the rolls are positioned against each other when they are cold, the motor driving the fuser/pressure roll pair would need more power. This may result in the motor stalling, and/or other inefficiencies.

In an exemplary embodiment, the voltage delivered to the fuser/pressure roll drive motor is measured. The current is proportional to the torque of the pressure roll and fuser roll pressed against each other. Because a closed loop velocity control for the fuser/pressure roll drive motor is used, the applied voltage may be used to determine the torque. This determined torque may be used to control the cam position to keep the motor torque under a predetermined limit, thus keeping the motor from stalling when the pressure roll is cold.

In an exemplary embodiment, the torque of the main drive motor may be monitored. When the torque reaches a value that is too high for the system, that is, likely to lead to a motor stall or other problems then the camming of the rolls against each other (i.e., the continued movement of the rollers toward each other) would stop. However, the rotational movement of each roll would continue. In this way, heat from one roll could be used to heat the other.

When the rollers are at a sufficient temperature, for example, at the end of a warm-up routine, the temperature of the pressure roll is increased, which will lower the chances of a motor stall. When the fuser roll is warmed up the xerographic device may cycle up and is ready to begin the imaging process.

In an exemplary embodiment, the closed loop control of the relative position of a fuser member and a pressure member of the fuser system occurs during the fuser warmup routine.

DETAILED DESCRIPTION OF EMBODIMENTS

A xerographic device of the exemplary embodiments may include a toner image forming station, a transfer station to transfer the toner image to an image receiving substrate, and a fuser system to fix the toner image to the image receiving substrate. At the toner image forming station, a latent image of an original image is developed, typically on the surface of a photoconductor or photoreceptor, using a suitable toner material. The developed toner image is then transferred to an image receiving substrate such as paper, a transparency, etc., at a transfer station. Following transfer to the image receiving substrate, the toner image must then be fixed to the image receiving substrate, which is done by a fuser system that applies heat and pressure to the substrate having the toner image thereon.

A fuser system of the exemplary embodiments includes a fuser member that may have, for example, a fuser roll, or a fuser belt traveling around one or more (fuser) rolls. The term "fuser member" as used herein collectively refers to any configuration of a fuser used to contact the toner image in fixing the toner image to the image receiving substrate. Similarly, the fuser system of the exemplary embodiments include a pressure member that may have, for example, a pressure roll, or a pressure belt traveling around one or more rolls. The term "pressure member" as used herein collectively refers to any member loaded against the fuser member and used to apply pressure to the image and media passed between the fuser member and pressure member.

Figure 1:
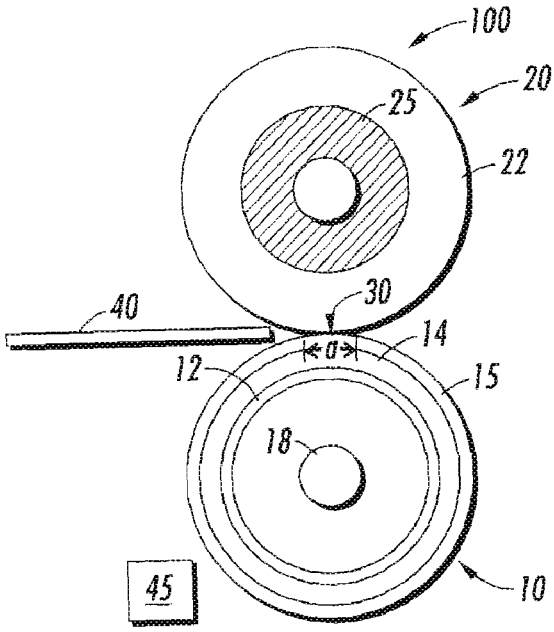
FIG. 1 illustrates a set of a fuser roll and a pressure roll for a xerographic device in an exemplary embodiment.

The fuser system may include a set of at least one pair of a fuser member, such as, for example, a fuser roll, and a pressure member, such as, for example, a pressure roll. One set of rolls of the fuser system is illustrated in the embodiment of FIG. 1. A fuser system 100 may include one or more sets of fuser and pressure rolls, as appropriate. For ease of illustration and description, however, the exemplary embodiments are described with respect to one set of fuser and pressure rolls in a roll only (non-belt) fuser system.

In the fuser system 100, a pressure roll 20 may be brought to exert pressure upon a fuser roll 10, thereby forming a nip 30 having a nip width "a" between the pressure roll 20 and fuser roll 10. An image receiving substrate 40 having a toner image thereon may be made to pass through the nip 30 such that the toner image contacts a surface of the fuser roll 10. The toner image may be fixed to the image receiving substrate via heat and pressure.

The fuser member 10 may have any construction and design, without limitation. However, in an exemplary embodiment, the fuser member 10 has one or more layers thereof including a material that has a tendency to harden or soften over time. For example, such materials may include silicone materials. The fuser member 10 may be a fuser roll that includes at least one layer having an affinity for thermoplastic materials (i.e., toner) such as, for example, a silicone material. The fuser roll 10 may include an outer layer 15 and an optional intermediate layer(s) 14 upon a base member 12 which may be either a solid or hollow cylinder or core fabricated from any suitable metal such as aluminum, anodized aluminum, steel, nickel, copper, and the like. A suitable heating element 18 may be disposed in the hollow portion of the cylinder or core. Alternatively, any suitable external heating option may also be used.

The intermediate layer(s) 14 may include, for example, a silicone rubber of a thickness so as to form a conformable layer. Other layers such as adhesive layers or other suitable layers may be incorporated between the outer layer 15 and the intermediate layer(s) 14, or between the hollow or solid core and the intermediate layer(s) 14.

The pressure roll 20 cooperates with fuser roll 10 to form the nip 30. The pressure roll 20 may include a rigid hollow steel (or other suitable hard material) core 25 with a soft surface layer 22 thereon.

Figure 2:
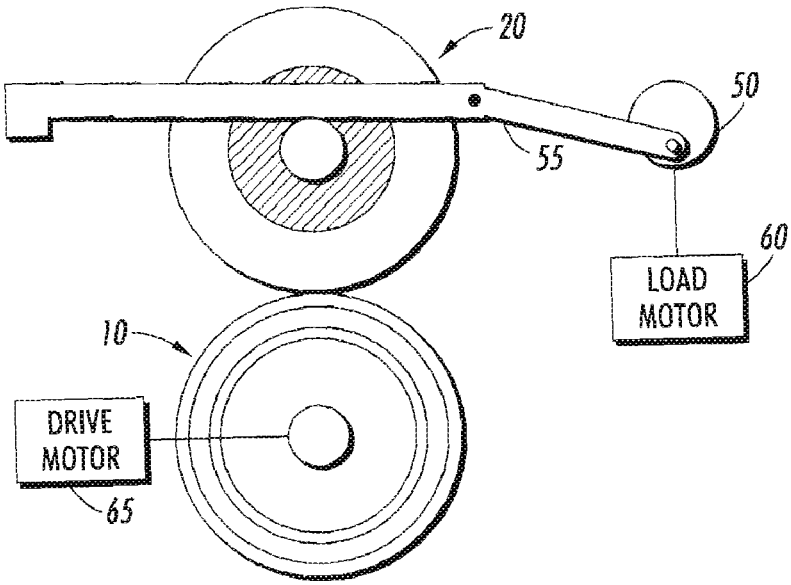
FIG. 2 illustrates a mounting structure for a pressure roll in which the pressure exerted upon the fuser member is adjustable with a cam.
Figure 3:
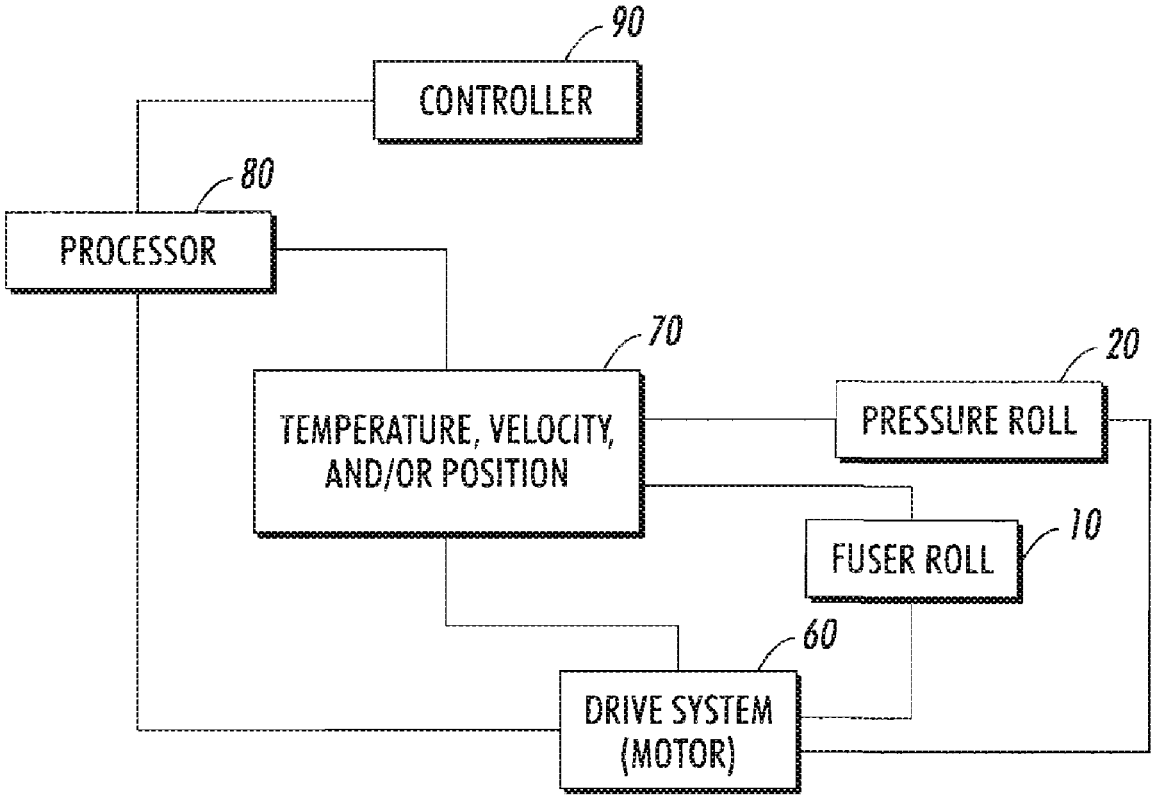
FIG. 3 illustrates the cooperative relationship between a sensor, pressure roll, processor, drive system, sensor and controller in an exemplary embodiment.

With reference to FIG. 2, in an exemplary embodiment, a fuser/pressure drive motor 65 drives the fuser roll 10 and the pressure roll 20. An output of a closed loop control algorithm determines the load on the fuser system. With reference to FIG. 3, according to this exemplary algorithm, a monitoring device, such as, for example, a sensor 70, may monitor any of numerous values within the fuser system, for example a temperature sensor for directly monitoring temperature of the fuser roll, a velocity sensor to measure a velocity within the system. The torque of the drive system (motor) 65 may be determined without a torque sensor to measure the torque applied by the motor, etc. In an exemplary embodiment, the pressure member 20 is driven by the fuser member 10 in the operation of the fuser system, and the sensor 70 measures the velocity and temperature of the fuser member.

A relationship between a monitoring device, fuser roll and pressure roll, processor, drive system, and controller in an exemplary embodiment is illustrated in FIG. 3. The monitoring sensor is labeled as 45 in FIG. 1.

Any suitable sensor known in the sensing art may be used, without limitation, to monitor the velocity, e.g., the velocity and/or temperature of the pressure roll and/or fuser roll (driven member). For a sensor measuring the velocity or temperature of the pressure roll 20, for example, the sensor may be located either internal within the pressure roll, or external to the pressure roll. For a sensor measuring the velocity or temperature of the fuser roll 10, for example, the sensor may be located either internal within the fuser roll or external to the fuser roll. For ease in maintenance and replacement, the sensor may be located external to the pressure roll and/or fuser roll.

The monitoring sensor 70 is in communication with a processor 80 so that the data measured by the sensor may be sent to the processor. The communication between the processor 80 and sensor 70 may be wireless, or by cabling between the sensor 70 and the processor 80, or by any means in which the processor 80 may be able to reliably receive the data from the monitoring sensor 70.

The processor 80 may evaluate the received data to determine a value for the measured, or current, torque applied to, for example, the fuser roll 10, or, the velocity of the fuser member 10 and/or the pressure roll 20. The processor 80 may also evaluate the received data to determine a value for the temperature of the fuser roll 10 and/or the pressure roll 20.

Once the torque, for example, is determined, it may be compared against a predetermined value. The predetermined value may be set, for example, based on the maximum torque that may be output by the motor 65 before a motor stall is anticipated, or by other criteria. If the torque is outside or above the predetermined value, the loading of the fuser/pressure roll pair will be stopped to control the amount of torque applied to avoid motor failure. After the temperature of the fuser roll 10 and/or the pressure roll 20 has reached an acceptable level, such that increased torque from the motor is not required, the processor 80 may signal a controller 90 to appropriately adjust the load in the fuser system, i.e., adjust the amount of pressure exerted by the pressure roll 20 against the fuser roll 10.

The controller may adjust, for example, increase the fuser load in situ in the closed loop process of the exemplary embodiments by any suitable means. For example, the load can be adjusted by changing a total cam lift, a spring preload, or any other physical displacement, in the loading mechanism. The loading mechanism is preferably associated with a mounting structure for the pressure roll of the fuser system.

Thus, in the exemplary embodiments, the relative position of the fuser member 10 and the pressure member 20 may be controlled using a method of measuring the drive motor torque; measuring the temperature of the fuser member 10 and/or pressure member 20; and/or by a control algorithm.

The fuser system of a xerographic device of the exemplary embodiments thus includes the controller 90 in communication with the processor 80, which can adjust and/or temporarily eliminate the torque applied to a fuser system until the fuser system reaches, for example, a predetermined temperature range. In exemplary embodiments, the controller is associated with the pressure roll in such a way that the pressure exerted by the pressure roll upon the fuser member may be adjusted, for example, to increase the pressure exerted by the pressure roll upon a detection that the outer layer of the fuser member or pressure member is hardening due to temperature or age of the system.

In the embodiment of FIG. 2, the pressure exerted upon the fuser roll 10 by the pressure roll 20 is adjustable with a cam 50 and cam follower 55 in the mounting structure of the pressure roll 20. The pressure roll 20 has two identical cam and cam follower located at both ends of the pressure roll 20, for simplicity only one end is illustrated in FIG. 2. As shown, the cam 50, external to the pressure roll 20, is linked to a cam follower 55. The cam follower 55, in turn, is linked to the pressure roll 20, either directly or through a mounting structure that might include springs. Upon appropriate rotation of the cam 50, via the motor 60, the cam follower 55 is made to put more load upon the pressure roll 20, thereby causing the pressure roll 20 to increase the amount of pressure exerted upon the fuser roll 10. The link between the cam 50 and cam follower 55 need not be direct as shown in FIG. 2, but may alternatively be made through an additional arm, with or without a spring associated with the additional arm, for example. The rotation of the cam can readily be controlled by the processor 90, as readily understood by one of ordinary skill in the art. The position of the fuser roll 10 is stationary but may be similarly adjusted.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A fuser system of a xerographic device, comprising:

a pressure member;

a fuser member, wherein the pressure member is made to exert pressure upon the fuser member so as to form a nip when the pressure member is engaged, and wherein a gap is defined between the pressure member and the fuser member when the pressure member is disengaged;

a drive system for driving at least the pressure member;

a sensor to monitor a temperature of at least one of the pressure member and the fuser member, wherein the sensor determines if the pressure member is engaged or disengaged; and a processor in communication with the sensor that receives temperature data from the sensor, wherein the processor determines a pressure applied to the fuser member by the pressure member based on the temperature data.

2. The fuser system according to claim 1, wherein a load system stops engaging the pressure member when the temperature of the at least one of the pressure member and the fuser member exceeds a predetermined value.

3. The fuser system according to claim 1, wherein the fuser member and the pressure member are held in a partially loaded state when the temperature of the at least one of the pressure member and the fuser member exceeds the predetermined value.

4. The fuser system according to claim 1, wherein the sensor monitors a torque of the drive system.

5. The fuser system according to claim 4, wherein the fuser member and the pressure member are held in a loaded state when the torque is below a predetermined value and when the at least one of the pressure member and the fuser member is below the predetermined temperature.

6. The fuser system according to claim 1, further comprising:

a mounting structure that supports the pressure member and the fuser member, wherein the mounting structure includes a first cam system associated with the fuser member and a second cam system associated with the pressure member.

7. The fuser system according to claim 6, further comprising:

a controller, in communication with the processor, for independently controlling the first cam system and the second cam system.

8. The fuser system according to claim 1, wherein the drive system drives the fuser and pressure members and the load system stops engaging the pressure member when the temperature of the at least one of the pressure member and the fuser member exceeds a predetermined value.

9. The fuser system according to claim 1, wherein the sensor monitors changes in current supplied to the drive system.

10. The fuser system according to claim 1, further comprising:

a system for closed loop control of the relative position of the fuser member and the pressure member based on the temperature of the at least one of the pressure member and the fuser member.

11. A method for fusing an image on a substrate in a xerographic device, the method comprising:

exerting pressure;

forming a nip with a fuser member and a pressure member in which the pressure member is made to exert pressure upon the fuser member;

driving at least the fuser member with a drive system;

monitoring a temperature of at least one of the pressure member and the fuser member;

processing temperature data to determine if the temperature of the at least one of the pressure member and the fuser member exceeds a predetermined value, wherein the drive system stops driving the fuser member when the temperature exceeds a predetermined value;

engaging at least one of a pressure member and disengaging a pressure member to form a nip by exerting pressure on a fusing member with the pressure member when the pressure member is engaged, and to form a gap between the pressure member and the fuser member when the pressure member is disengaged; and monitoring the temperature of the at least one of the pressure member and the fuser member with a sensor, wherein the sensor determines if the pressure member is engaged or disengaged.

12. The method according to claim 11, further comprising:

determining a pressure applied to the fuser member by the pressure member based on the temperature data.

13. The method according to claim 11, further comprising:

holding the fuser member and the pressure member in a partially loaded state when the temperature of the at least one of the pressure member and the fuser member exceeds the predetermined value.

14. The method according to claim 11, further comprising:

monitoring a torque of the drive system.

15. The method according to claim 14, further comprising:

holding the fuser member and the pressure member in a loaded state when the torque is below a predetermined value and when the pressure member and/or the fuser member is below the predetermined temperature.

16. The method according to claim 11, further comprising:

supporting the pressure member and the fuser member with a mounting structure, wherein the mounting structure includes a first cam system associated with the fuser member and a second cam system associated with the pressure member; and independently controlling the first cam system and the second cam system with a controller when the temperature of the at least one of the pressure member and the fuser member exceeds the predetermined value.

17. The method according to claim 14, further comprising:

monitoring changes in voltage supplied to the drive system, wherein the drive system drives the pressure member and the drive system stops driving the pressure member when the torque exceeds a predetermined value.

18. The method according to claim 11, further comprising:

providing a system for closed loop control of the relative position of the fuser member and the pressure member based on the temperature of the at least one of the pressure member and the fuser member.

19. A storage medium on which is recorded a program for controlling the relative position of the fuser member and the pressure member based on the temperature of the at least one of the pressure member and fuser member, the program implementing the method of claim 11.

20. A system for fusing an image on a substrate in a xerographic device, the system comprising:

means for forming a nip with a fuser member and a pressure member in which the pressure member is made to exert pressure upon the fuser member; driving means for driving at least the fusing member;

driving means for driving at least the fusing member;

means for monitoring temperature of at least one of the pressure member and the fuser member; and means for processing temperature data to determine if the temperature of the at least one of the pressure member and the fuser member exceeds a predetermined value, wherein the driving of the fusing member stops when the temperature exceeds the predetermined value.

* * * * *